US006315343B1

(12) United States Patent
Karlsson

(10) Patent No.: US 6,315,343 B1
(45) Date of Patent: Nov. 13, 2001

(54) GUIDE FOR STACKING CONTAINERS

(75) Inventor: Gösta Karlsson, Killeberg (SE)

(73) Assignee: Elmhults Konstruktions AB, Almhult (SE)

( * ) Notice: Subject to any disclaimer, the term of this patent is extended or adjusted under 35 U.S.C. 154(b) by 0 days.

(21) Appl. No.: 09/401,243

(22) Filed: Sep. 23, 1999

(30) Foreign Application Priority Data

Sep. 24, 1998 (SE) ..... 9803241

(51) Int. Cl.[7] ..... B66C 1/66
(52) U.S. Cl. ..... 294/81.41; 294/81.51
(58) Field of Search ..... 294/81.1, 81.2, 294/81.21, 81.4, 81.41, 81.51, 81.61, 68.3; 414/607, 608

(56) References Cited

U.S. PATENT DOCUMENTS 3,897,098 * 7/1975 Haertig ..... 294/81.41
4,063,770 * 12/1977 Guthrie ..... 294/81.41
4,172,685 * 10/1979 Nabeshima et al. ..... 294/81.41 X
4,795,203 * 1/1989 Karlsson ..... 294/81.51
5,354,112 * 10/1994 Hara et al. ..... 294/81.41

FOREIGN PATENT DOCUMENTS

3621648 * 1/1988 (DE) ..... 294/81.51
1557373 * 2/1969 (FR) ..... 294/81.51
1379969 * 1/1975 (GB) ..... 294/81.21

* cited by examiner

*Primary Examiner*—Johnny D. Cherry
(74) *Attorney, Agent, or Firm*—Jones, Day, Reavis & Pogue

(57) ABSTRACT

A guide for stacking containers (6) on top of one another with the aid of a container derrick (1). The container derrick supports four arms that pivot up and down at the container derrick where each when in a swung-down position with its lower, essentially L-shaped end (11) extends under the bottom of the container (6) carried by the container derrick (1) and encloses the sides of a lower corner of the container and that (9) when in a swung-up position is located above the container and within its horizontal projection.

4 Claims, 3 Drawing Sheets

GUIDE FOR STACKING CONTAINERS

BACKGROUND OF THE INVENTION

1. Field of the Invention

The present invention relates to a guide for stacking containers on top of one another with the aid of a container derrick.

2. Description of the Related Art

The use of containers for transporting goods can to a large extent be considered to dominate today. Gathering together containers for filling or emptying thus requires increasingly greater space, which is the reason why containers are stacked on top of one another. In some container terminals, up to 12–13 units can be arranged in stacks. A small displacement of the containers in relation to one another can easily cause such a stack to topple over. Different attempts to make it easier for crane operators to place a container exactly above another container have been made. One solution to the problem is the use of a type of guide, so-called "stacking guides" arranged in the container derrick and comprising a type of telescopic arm that is lowered down along each short end of the container until each respective arm is about 10 cm below the bottom of the container. Cone-shaped corner guides are arranged at the lower ends of the arms and these are locked firmly in the lower corner boxes of the container. With parts that extend under the bottom of the container, the arms provide guidance of the container over the container below when the operator lowers the container down over the stack. This is a complicated procedure and due to fitting the cone-shaped parts of the arms into the corner boxes of the container, it is also time-consuming.

Through Swedish patent 8604144-9, arranging pivoting arms on a combination derrick intended to grasp under, for example, containers or trailers by means of heels in order to raise or lower them is known. With the aid of this mechanism used according to this patent, it is possible to achieve, as the invention is expressed in the characteristics section of the claims, a quick and simple guidance of a container for stacking this on top of another container.

BRIEF DESCRIPTION OF THE SEVERAL VIEWS OF THE DRAWING

The invention will be described in the form of an example with reference to the drawings where.

DETAILED DESCRIPTION OF THE INVENTION

Figure 2:
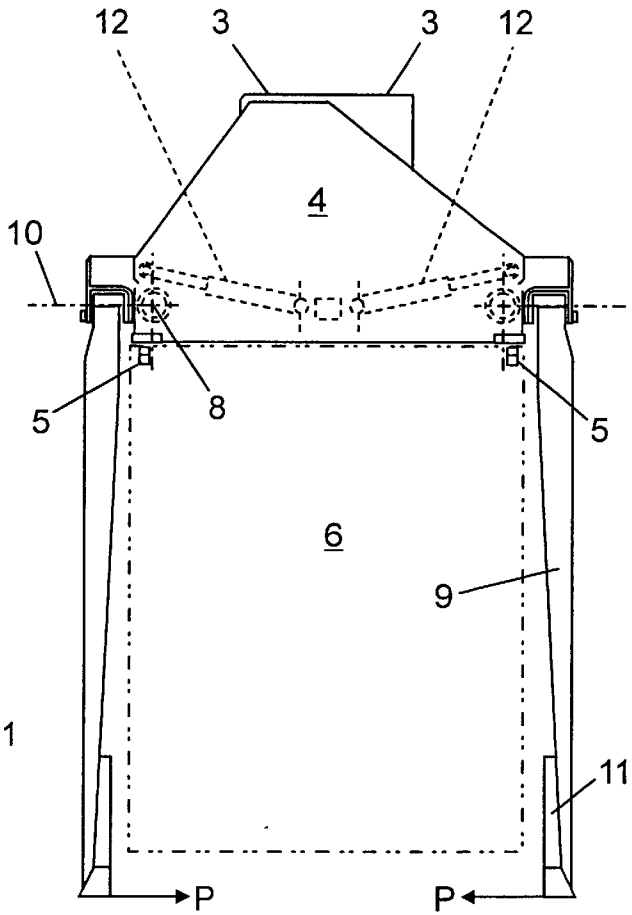
FIGS. 1 and 2 show the invention with the arms pivoted downwards seen from the side and end, respectively.

What is a per se known container derrick is illustrated and in the known way it comprises a main beam 2 in which, for example, two travelling beams (not shown in the figures but indicated for the purposes of explanation by 3 in FIG. 2) are arranged each supporting a cross beam 4. With the aid of known so-called twistlocks 5, the container derrick supports a container 6 indicated by a dotted and dashed line via the cross beams 4. The container derrick 1 and the container 6 are supported in a known and conventional manner within this technology by the arm of a crane (not shown). With the aid of the travelling beams (indicated by 3), the container derrick is adapted to different lengths of container.

At the outer ends of the respective cross beams 4 there are turnable derricks 7 arranged to pivot around a first, essentially horizontal axis 8 that extends along the container derrick. The respective pivoting derricks 7 support a guide arm 9 that is housed in pivoting derrick 7 to pivot around an axis 10 that runs essentially at right angles to axis 8. At its lower end, the respective guiding arm 9 is also provided with an L-shaped profile 11, whose lower edge is angled outwards at an oblique angle. Pivoting of the turntable derrick 7 around axis 8 takes place with the aid of a hydraulic cylinder 12 attached to the cross beam 4. Pivoting of the guiding arm 9 around axis 10 takes place with the aid of a hydraulic cylinder 13 acting between an attachment 14 on guiding arm 9 and an attachment 15 on the turntable derrick 7.

Figure 1:
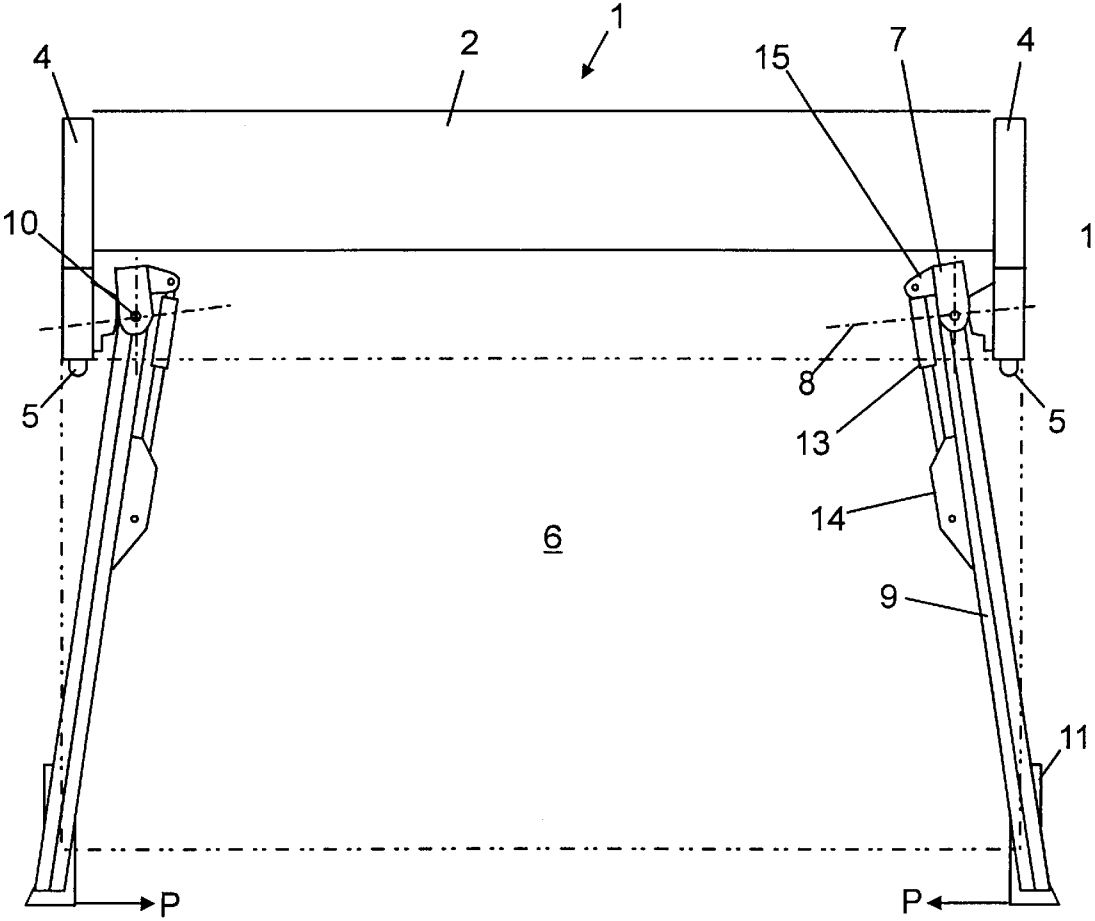

FIGS. 1 and 2 show the guiding arms swung downwards to a position before the arms with the L-shaped ends move to enclose the sides of the container 6 (see arrows P). As is clearly evident, the free ends of the guiding arms 9 extend below the bottom surface of the container 6.

Figure 3:
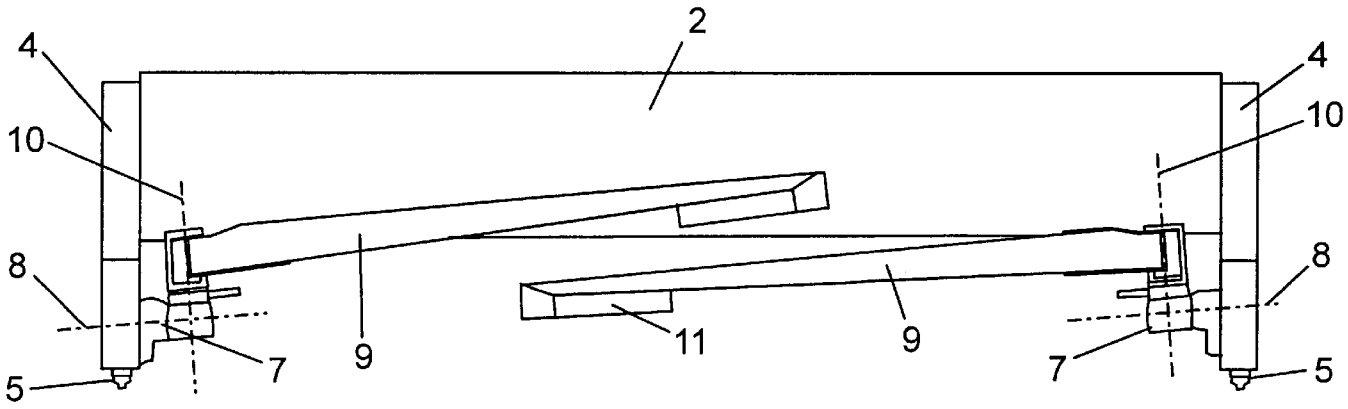
FIGS. 3 and 4 show the invention with the arms pivoted upwards seen from the side and above, respectively.
Figure 4:
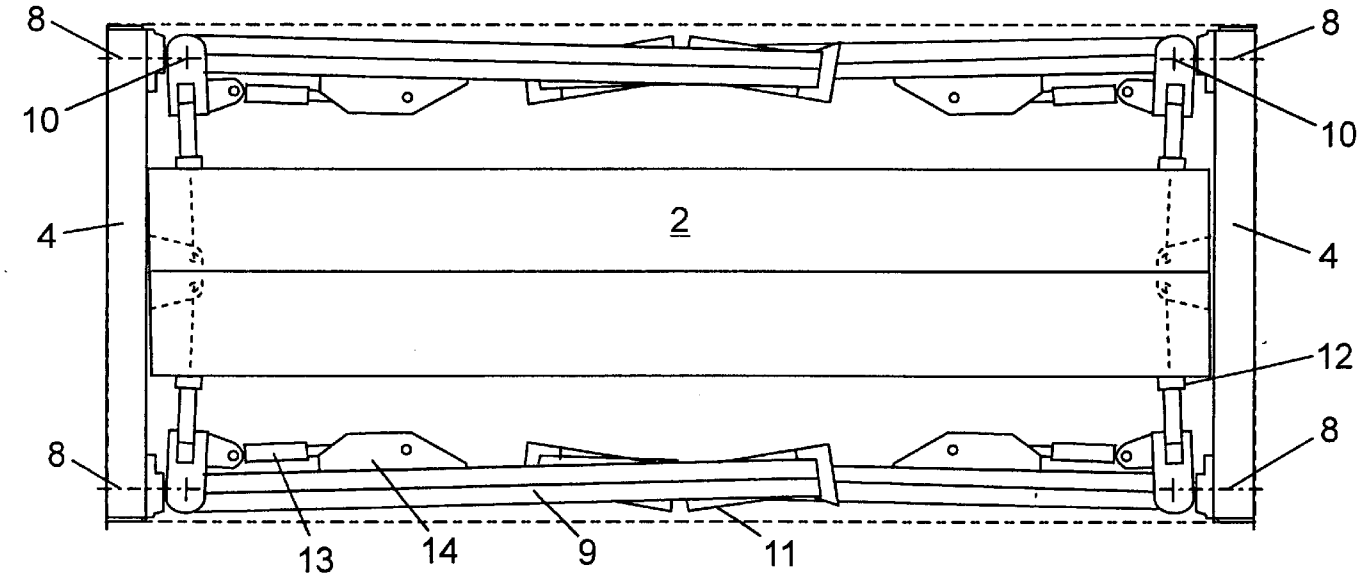

FIGS. 3 and 4 show the guiding arms in their upper resting position. So that the guiding arms 9 do not knock or lie against one another in this position, the turning axes 8 are arranged at an incline, as is evident from the figures. As is clearly evident from FIG. 4, when the guiding arms 9 are in the swung-up position, they are located wholly within the horizontal projection of the container 6 and do thus not hinder the handling of the container.

Figure 5:
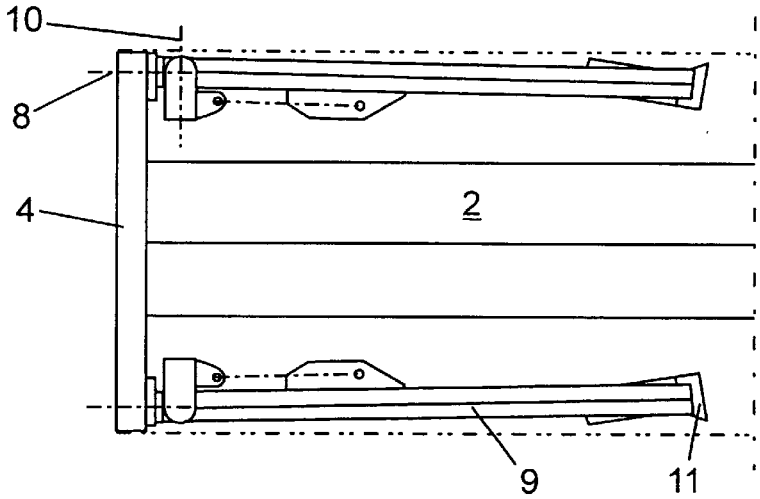
FIGS. 5–7 show a pivoting sequence for two arms.
Figure 6:
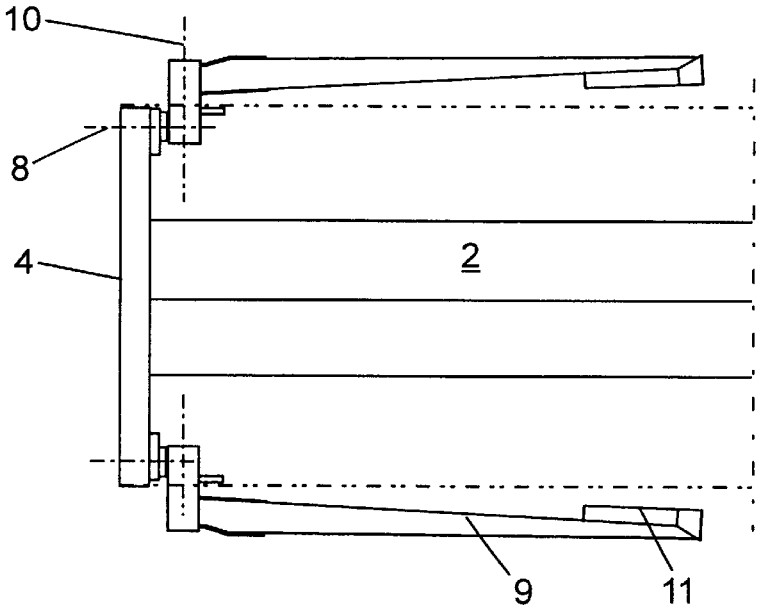
Figure 7:
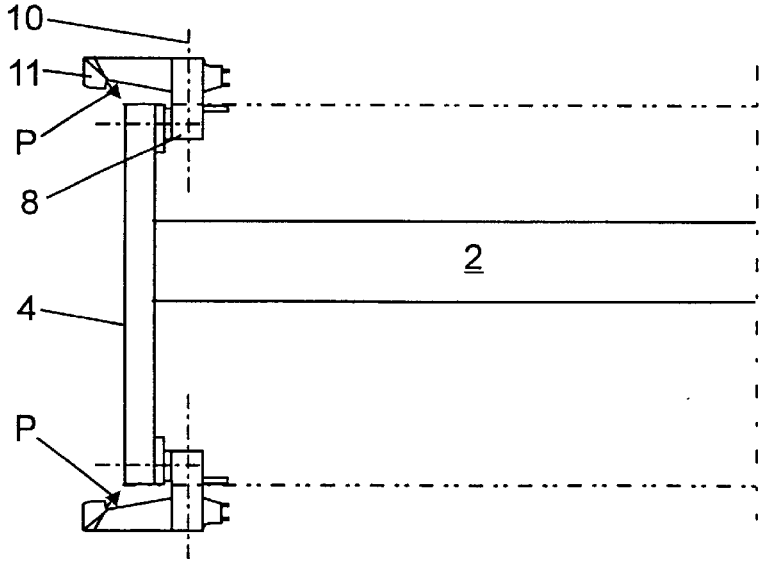

For the purpose of clarification, FIGS. 5–7 only show two of the guiding arms 9 of the derrick 1 connected to a cross beam 4. FIG. 5 shows the arms swung-up in a non-working position above a container 6 (compare with FIG. 4). To swing down guiding arms 9, the turning derricks 7 (see FIG. 6) are pivoted around their axes 8 so that the arms swing outwards to extend out from the sides of the container 6. Following this, the guiding arms 9 (see FIG. 7) are swung down around axes 10 to the position shown in FIGS. 1 and 2. With the aid of the hydraulic cylinders 12 and 13, the arms are then moved in towards the corners of the container 6, indicated by arrows P (FIG. 7) so that the sections 11 with the L-shaped profiles can enclose the corners of the container. The force with which sections 11 can enclose the corners of the container is about 10,000 N, which is sufficient for the angled, guiding end pieces of parts 11 to securely guide the container 6 in over the container below. Container 6 will by necessity take up a position directly above the container below.

When the container is in position, the process of moving the guiding arms 9 is the reverse of that described above.

As is evident from the figures, the lower ends of the arms that extend below the bottom of the containers are provided with separate sections 11 that have an L-shape and that are somewhat angled in relation to the guiding arms 9 in order to ensure that when the guiding arms swing inwards towards the corners of the container 6, the ends—the L-shaped profiles—shall make a connection with them.

What is claimed is:

1. A guide for stacking containers (6) on top of one another with the aid of a container derrick (1) comprising:

four arms (9) supported by the container derrick (1), said arms pivotable up and down at the container derrick where each arm when in a swung-down position, extends a lower, essentially L-shaped end (11) under a bottom of the container (6) carried by the container derrick (1) and encloses sides of a lower corner of the container and that each arm (9) when in a swung-up position is located above the container and within a horizontal projection of the container, wherein lower edges of an upper container may be positioned in registry with upper edges of a lower container.

2. A guide according to claim 1 wherein:

each arm (9) pivots around a first essentially horizontal axis (8) that extends lengthwise of the container derrick and a second pivoting axis (10) that runs essentially at right angles in relation to the first axis.

3. A guide according to claim 1 wherein:

a lower end of each arm (9) has lower edges angled obliquely outwards.

4. A guide according to claim 1 wherein:

a lower end of each arm has lower edges beveled outwards.

* * * * *